US006097365A

United States Patent [19]

Makino

[11] Patent Number: 6,097,365

[45] Date of Patent: Aug. 1, 2000

[54] COLOR PLASMA DISPLAY PANEL HAVING A PLURALITY OF DATA DRIVERS

[75] Inventor: Mitsuyoshi Makino, Tokyo, Japan

[73] Assignee: NEC Corporation, Tokyo, Japan

[21] Appl. No.: 08/993,655

[22] Filed: Dec. 18, 1997

[30] Foreign Application Priority Data

Dec. 19, 1996 [JP] Japan ..... 8-339549

[51] Int. Cl.[7] ..... G09G 3/36; G09G 3/28

[52] U.S. Cl. ..... 345/99; 345/88; 345/60

[58] Field of Search ..... 345/60, 72, 155, 345/88, 99; 313/584

[56] References Cited

U.S. PATENT DOCUMENTS

| | | | |
|---|---|---|---|
| 4,814,758 | 3/1989 | Park | 345/72 |
| 5,019,807 | 5/1991 | Stapleton et al. | 345/152 |
| 5,583,527 | 12/1996 | Fujisaki et al. | 345/60 |
| 5,818,405 | 10/1998 | Eglit et al. | 345/88 |

FOREIGN PATENT DOCUMENTS 2-125289 5/1990 Japan .

3-290618 12/1991 Japan .

OTHER PUBLICATIONS

T. Nakamura et al., "Drive for 40–in.–Diagonal Full–Color ac Plasma Display", *SID 95 Digest*, 1997, pp. 807–810.

*Primary Examiner*—Mark R. Powell
*Assistant Examiner*—Anthony J. Blackman
*Attorney, Agent, or Firm*—Sughrue, Mion, Zinn Macpeak & Seas, PLLC

[57] ABSTRACT

A color plasma display panel having a plurality of data drivers is disclosed. Data drivers which output data pulses for writing display information into pixels are divided for different emitted light colors, that is, into an R data driver, a G data driver and a B data driver. The R data driver is connected to data electrodes which form pixel columns of R, the G data driver is connected to data electrodes which form pixel columns of G, and the B data driver is connected to data electrodes which form pixel columns of B. The R data driver, G data driver and B data driver can adjust the data pulse widths, output voltages and output timings thereof independently of each other.

10 Claims, 10 Drawing Sheets

COLOR PLASMA DISPLAY PANEL HAVING A PLURALITY OF DATA DRIVERS

BACKGROUND OF THE INVENTION

1. Field of the Invention

This invention relates to a color plasma display panel (color PDP) for use in a personal computer, a work station, a wall television or the like as a flat display in which a large display area is easily obtained.

2. Description of the Related Art

Color PDPs are classified, according to an operation method, into the DC type wherein electrodes are exposed to discharge gas and discharge occurs only for a time for which a voltage is applied to the electrodes and the AC type wherein electrodes are covered with a dielectric and discharge without being exposed to discharge gas. In color PDPs of the AC type, a discharge cell itself has a memory function based on a charge accumulating operation of the dielectric.

An example of a construction of an ordinary AC type color PDP is described with reference to FIG. 1. The color PDP has the following structure formed in a space defined between front substrate 10 formed from glass and back substrate 11 formed from glass similarly.

Scanning electrodes $\mathbf{12}_1$ to $\mathbf{12}_m$ and common electrodes 13 are formed in a predetermined spaced relationship from each other on front substrate 10. In the sectional view of FIG. 1, however, from among scanning electrodes $\mathbf{12}_1$ to $\mathbf{12}_m$, only scanning electrodes $\mathbf{12}_{m-2}$ to $\mathbf{12}_m$ are shown. Scanning electrodes $\mathbf{12}_{m-2}$ to $\mathbf{12}_m$ and common electrodes 13 are covered with insulating layer 15*a*. Further, protective layer 16 formed from MgO or a like material for protecting insulating layer 15*a* from discharge is formed on insulating layer 15*a*.

Data electrodes $\mathbf{19}_1$ to $\mathbf{19}_n$ are formed perpendicularly to scanning electrodes $\mathbf{12}_{m-2}$ to $\mathbf{12}_m$ and common electrodes 13 on back substrate 11. Data electrodes $\mathbf{19}_1$ to $\mathbf{19}_n$ are covered with insulating layer 15*b*. Further, phosphor 18 for converting ultraviolet rays generated by discharge into visible rays to effect displaying is painted on insulating layer 15*b*.

Partitions 17 for assuring discharge space 20 and defining pixels are formed between insulating layer 15*a* on front substrate 10 and insulating layer 15*b* on back substrate 11.

Further, mixture gas of He, Ne, Xe and so forth is enclosed as discharge gas in discharge space 20.

Next, a plane view showing an electrode structure of the color PDP of FIG. 1 is shown in FIG. 2.

Referring to FIG. 2, the electrode structure of the color PDP includes m scanning electrodes $\mathbf{12}_1$ to $\mathbf{12}_m$ formed to extend in the direction of a row and n data electrodes $\mathbf{19}_1$ to $\mathbf{19}_n$ formed to extend in the direction of a column such that a pixel is formed at each of intersecting points of scanning electrodes $\mathbf{12}_1$ to $\mathbf{12}_m$ and data electrodes $\mathbf{19}_1$ to $\mathbf{19}_n$. Common electrodes 13 extend in parallel to scanning electrodes $\mathbf{12}_1$ to $\mathbf{12}_m$. The color PDP is obtained by selectively painting phosphor 18 of FIG. 1 with three colors of R, G and B for the individual pixels.

Next, a structure diagram showing drivers of the color PDP of FIG. 1 and a pixel arrangement in the color PDP is shown in FIG. 3, and pulse waveforms applied to common electrodes 13, scanning electrodes $\mathbf{12}_1$ to $\mathbf{12}_m$ and data electrodes $\mathbf{19}_1$ to $\mathbf{19}_n$ are illustrated in FIG. 4.

Referring to FIGS. 3 and 4, sustaining control driver 3 controls sustaining drivers 1 and 2 to generate sustaining pulses for causing sustaining discharge to occur. Sustaining driver 1 is controlled by sustaining control driver 3 and outputs sustaining pulses 25 for causing sustaining discharge to occur to common electrodes 13. Sustaining driver 2 is controlled by sustaining control driver 3 and outputs sustaining pulses 26 for causing sustaining discharge to occur to scanning electrodes $\mathbf{12}_1$ to $\mathbf{12}_m$ via scanning driver 4. Scanning driver 4 outputs scanning pulses 24 for causing write discharge to occur to scanning electrodes $\mathbf{12}_1$ to $\mathbf{12}_m$ at different timings from each other and outputs sustaining pulses 26 outputted from sustaining driver 2 to scanning electrodes $\mathbf{12}_1$ to $\mathbf{12}_m$. Data driver 5 outputs data pulses 27 for causing write discharge to occur to data electrodes $\mathbf{19}_1$ to $\mathbf{19}_n$ at timings at which scanning pulses 24 are outputted.

Scanning pulse 24 and sustaining pulses 25 and 26 are outputted commonly to a plurality of pixels arranged in order of RGB . . . RGB which belong to a row connected to a same scanning electrode from among scanning electrodes $\mathbf{12}_1$ to $\mathbf{12}_m$.

Both sustaining driver 1 which outputs sustaining pulses 25 to common electrodes 13 and sustaining driver 2 which outputs sustaining pulses 26 to scanning electrodes $\mathbf{12}_1$ to $\mathbf{12}_m$ receive control signals from sustaining control driver 3. The control signals from sustaining control driver 3 determine oscillation frequencies of sustaining pulses 25 and 26.

Actually, drivers and other elements for producing erasure pulses for erasing a displayed screen are required additionally. However, they are omitted for simplified illustration and description.

Now, a driving method of the conventional color PDP is described with reference to FIG. 4.

FIG. 4 is a timing chart illustrating driving voltage waveforms applied to the color PDP of FIG. 1.

When it is intended to display certain display information on the color PDP, erasure pulses 21 are individually applied to scanning electrodes $\mathbf{12}_1$ to $\mathbf{12}_m$ to erase those pixels which have emitted light prior to the time illustrated in FIG. 4 to put all pixels into an erased state.

Then, priming discharge pulse 22 is applied to common electrodes 13 to cause all pixels to compulsorily discharge and emit light. Further, priming discharge erasure pulses 23 are individually applied to scanning electrodes $\mathbf{12}_1$ to $\mathbf{12}_m$ to erase the priming discharge of all pixels. By this priming discharge, later write discharge is facilitated.

After the erasure of the priming discharge, scanning pulses 24 are applied at timings shifted from each other to scanning electrodes $\mathbf{12}_1$ to $\mathbf{12}_m$, and in a timed relationship with the timings at which scanning pulses 24 are applied, data pulses 27 according to the display information are applied to data electrodes $\mathbf{19}_1$ to $\mathbf{19}_n$. By this operation, display data corresponding to the display information are displayed on the pixels.

Here, in a timed relationship with the timings at which scanning pulses 24 are applied, write discharge occurs with those pixels to which data pulses 27 are applied. However, if data pulses 27 are not applied at the timings at which scanning pulses 24 are applied, no write discharge occurs with those pixels.

Then, in order to sustain the data written by the write discharge, sustaining driver 1 outputs sustaining pulses 25 to common electrodes 13 in response to an instruction of sustaining control driver 3. In those pixels with which write discharge has occurred, positive charge called wall charge is accumulated on insulating layer 15*a* on scanning electrodes $\mathbf{12}_1$ to $\mathbf{12}_m$. By superposition of the positive potential by the wall charge and the first sustaining pulse 25 applied to common electrodes 13, the first sustaining discharge occurs. When the first sustaining discharge occurs, positive wall charge is accumulated on insulating layer 15*a* on common electrodes 13 while negative wall charge is accumulated in insulating layer 15*a* on scanning electrodes $\mathbf{12}_1$ to $\mathbf{12}_m$.

Then, in response to an instruction of sustaining control driver 3, sustaining driver 2 outputs sustaining pulses 26 to scanning electrodes $\mathbf{12}_1$ to $\mathbf{12}_m$ respectively. Consequently, the second sustaining pulses 26 applied to scanning electrodes $\mathbf{12}_1$ to $\mathbf{12}_m$ are superposed with the potential differences by the wall charge accumulated as a result of the first sustaining discharge, and second sustaining discharge occurs. This operation is repeated so that the potential differences by wall charge formed by the xth time sustaining discharge and x+1th time sustaining pulses are superposed with each other to continue the sustaining discharge. Further, the magnitude of the emitted light amount is determined by the magnitude of the number of continuation times of sustaining discharge.

If the voltages of sustaining pulses 25 and sustaining pulses 26 are adjusted in advance so that discharge may not occur with the pulse voltages themselves, then since a potential difference by wall charge does not appear with those pixels with which write discharge has not occurred, even if the first sustaining pulses 25 are applied to them, the first sustaining discharge does not occur with them and also later sustaining discharge does not occur with them either.

Write discharge which determines emission or no emission of light for each pixel is opposed discharge which occurs in an opposed discharge gap which is an air gap between insulating layer 15*a* on front substrate 10 and insulating layer 15*b* on back substrate 11 in discharge space 20 and is also the height of partitions 17. Meanwhile, sustaining discharge which determines the emitted light amount is surface discharge which occurs in surface discharge gaps which are gaps between scanning electrodes $\mathbf{12}_1$ to $\mathbf{12}_m$ and common electrodes 13 similarly in the inside of discharge space 20.

Now, a discharge selection operation for each pixel is described more particularly with reference to FIGS. 5*a* and 5*b*. FIG. 5*a* is a view showing one picture element which is a set of three pixels of R, G and B, and FIG. 5*b* is a diagram showing driving waveforms in the proximity of a scanning pulse when write discharge is caused to occur with the pixels of G and B except the pixel of R. Slanting lines of the R pixel in FIG. 5*a* indicate that the pixel does not emit light.

The picture element shown in FIG. 5*a* is an arbitrary one picture element in an RGB pixel matrix including a B pixel in the ith row and the jth column, a G pixel in the ith row and the (j−1)th column, and an R pixel in the ith row and the (j−2)th column. Here, the range of i is $1 \leqq i \leqq m$, and the values which may be taken by j are j=3, 6, 9, . . . , n−6, n−3, and n.

In FIG. 5*a,* since scanning electrode $\mathbf{12}_i$ extends across the pixels of R, G and B which form one picture element, scanning pulse 24 is applied simultaneously to the pixels of R, G and B which form the picture element. Then, while scanning pulse 24 is applied, data pulses 27 are applied to data electrodes $\mathbf{19}_{j-1}$ and $\mathbf{19}_j$ of the G pixel and the B pixel while no pulse is applied to data electrode $\mathbf{19}_{j-2}$ of the R pixel. Consequently, although write discharge occurs with and sustaining discharge is thereafter performed for the G and B pixels, write discharge does not occur with and sustaining discharge is not thereafter performed for the R pixel. In this manner, selection of emission or no emission of light of R, G and B pixels which form one picture element is performed while scanning pulse 24 is outputted once.

Generally, pixels of individually same emitted light colors are connected to data electrodes $\mathbf{19}_1$ to $\mathbf{19}_n$, and this is because painting of phosphor can be performed accurately and readily by screen printing.

Further, the requirements for performing appropriate write discharge are different individually for the R, G and B pixels depending upon differences in charging characteristics of the phosphor and so forth.

FIG. 6*a* is a characteristic diagram illustrating an example of a data pulse voltage range necessary for write discharge when a same scanning pulse is applied, and FIG. 6*b* is a characteristic diagram illustrating another example of a data pulse voltage range necessary for write discharge.

Referring to FIG. 6*a,* it can be seen that the lowest limit data pulse voltage for causing write discharge to occur with a G pixel is higher by approximately 10 V than those of R and B pixels. Further, a data pulse voltage which can be set for each pixel has an upper limit, and if a data pulse voltage higher than the upper limit value is applied, then abnormal discharge is generated, and an appropriate writing operation cannot be performed.

Consequently, if it is tried to drive light emitting pixels of the three colors of R, G and B with a same data pulse, then the voltages must be set so as to be higher than the lower limits of the data pulse voltage ranges of all pixels of the three colors but lower than the upper limits of the data pulse voltage ranges of all pixels of the three colors. In FIG. 6*a,* the very narrow range from 68 V which is the lower limit to the G pixels to 69 V which is the upper limit to the B pixels is a voltage setting margin. If data pulses 27 go out of the voltage setting margin, then write discharge is not performed appropriately, resulting in deterioration of the display quality.

As described above, a conventional color PDP has a problem in that, since data pulses of the same voltage value and the same pulse width are outputted from one data driver to pixels of different emitted light colors, where the discharge characteristics of the individual pixels are different depending upon the difference in emitted light color, the setting margin for data pulses becomes narrow and appropriate write discharge cannot be performed, resulting in deterioration in display quality.

SUMMARY OF THE INVENTION

It is an object of the present invention to provide a color PDP wherein appropriate write discharge can be performed for a pixel of any emitted light color to assure improved display quality.

In order to attain the object described above, a color plasma display panel of the present invention comprises a scanning driver for outputting scanning pulses at different timings from each other to a plurality of scanning electrodes provided on a row side of an RGB pixel matrix, and a data driver for outputting data pulses corresponding to display information to be displayed by a plurality of data electrodes provided on a column side of the RGB pixel matrix in a timed relationship with the timings at which the scanning pulses are outputted.

The data driver includes a first data driver for outputting data pulses only to R pixel columns of the RGB pixel matrix, a second data driver for outputting data pulses only to G pixel columns of the RGB pixel matrix, and a third data driver for outputting data pulses only to B pixel columns of the RGB pixel matrix.

The present invention makes it possible to adjust setting conditions of data pulses for the individual emitted light colors by providing the data drivers, which output data pulses for writing display information into the individual pixels, for the individual emitted light colors.

Accordingly, appropriate write discharge can be performed with the pixels of the individual emitted light colors, and the display quality of the entire screen can be improved. Further, since the voltage of data pulses for performing write discharge can be set for each of the pixels of the individual emitted light colors, the voltages of data pulses to be applied to the pixels of the individual emitted light colors can be controlled to their necessary and lowest levels, and the power dissipation of the data driver can be reduced.

Meanwhile, another color plasma display panel of the present invention is constructed such that the data driver described above includes a first data driver for outputting data pulses to two kinds of pixel columns from among three kinds of pixel columns of R, G and B of an RGB pixel matrix, and a second data driver for outputting data pulses to the remaining one kind of pixel columns.

The present invention provides a data driver which outputs data pulses for writing display information into the individual pixels for exclusive use for one emitted light color whose write discharge characteristic is much different from those of the pixels of the other emitted light colors such that, by varying the setting conditions of data pulses only for the pixels of the one emitted light color, a characteristic difference by the emitted light colors of the pixels may be reduced.

Accordingly, appropriate write discharge can be performed for the pixels of the individual emitted light colors, and the display quality of the entire screen can be improved.

According to another embodiment of the present invention, each of the data drivers can adjust at least one of an output pulse width, an output voltage and an output timing thereof independently of each other.

According to a further embodiment of the present invention, when output signal lines of the data drivers are to be connected to the data electrodes, they are re-arranged using a multi-layer substrate.

The present invention wires the output signal lines of the data drivers in different layers of the multi-layer substrate so that they may be re-arranged to an arrangement corresponding to the arrangement of the data electrodes to be connected.

Accordingly, connection between the output signal lines and the data electrodes can be facilitated.

Further, a further color plasma display panel of the preset invention is constructed such that the data driver described above can output data pulses of at least two different voltage values.

The present invention makes voltages of data pulses to be outputted from one data driver different for the individual emitted light colors so that appropriate write discharge may occur with the pixels of the individual emitted light colors.

Accordingly, appropriate write discharge can be performed for the pixels of the individual emitted light colors, and the display quality of the entire screen can be improved.

The above and other objects, features, and advantages of the present invention will become apparent from the following description with reference to the accompanying drawings which illustrate examples of the present invention.

DETAILED DESCRIPTION OF THE PREFERRED EMBODIMENTS

First Embodiment

In the following, a first embodiment of the present invention is described with reference to FIG. 7.

Figure 7:
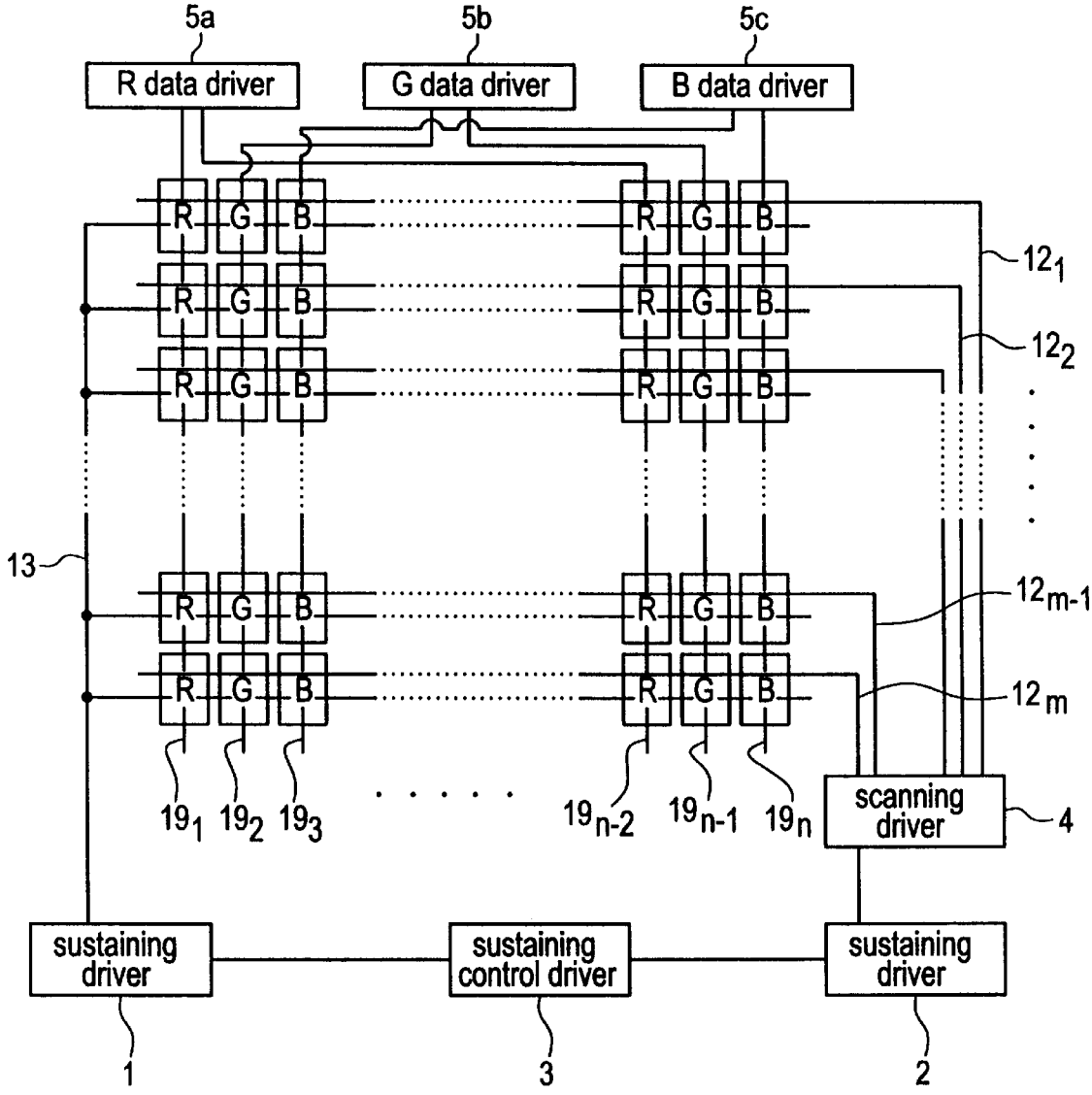
FIG. 7 is a structure diagram showing drivers of a color PDP of a first embodiment of the present invention and a pixel arrangement in the color PDP.

FIG. 7 is a structure diagram showing drivers of a color PDP of the first embodiment of the present invention and a pixel arrangement in the color PDP. In FIG. 7, same reference symbols as those in FIG. 3 denote same components.

Figure 1:
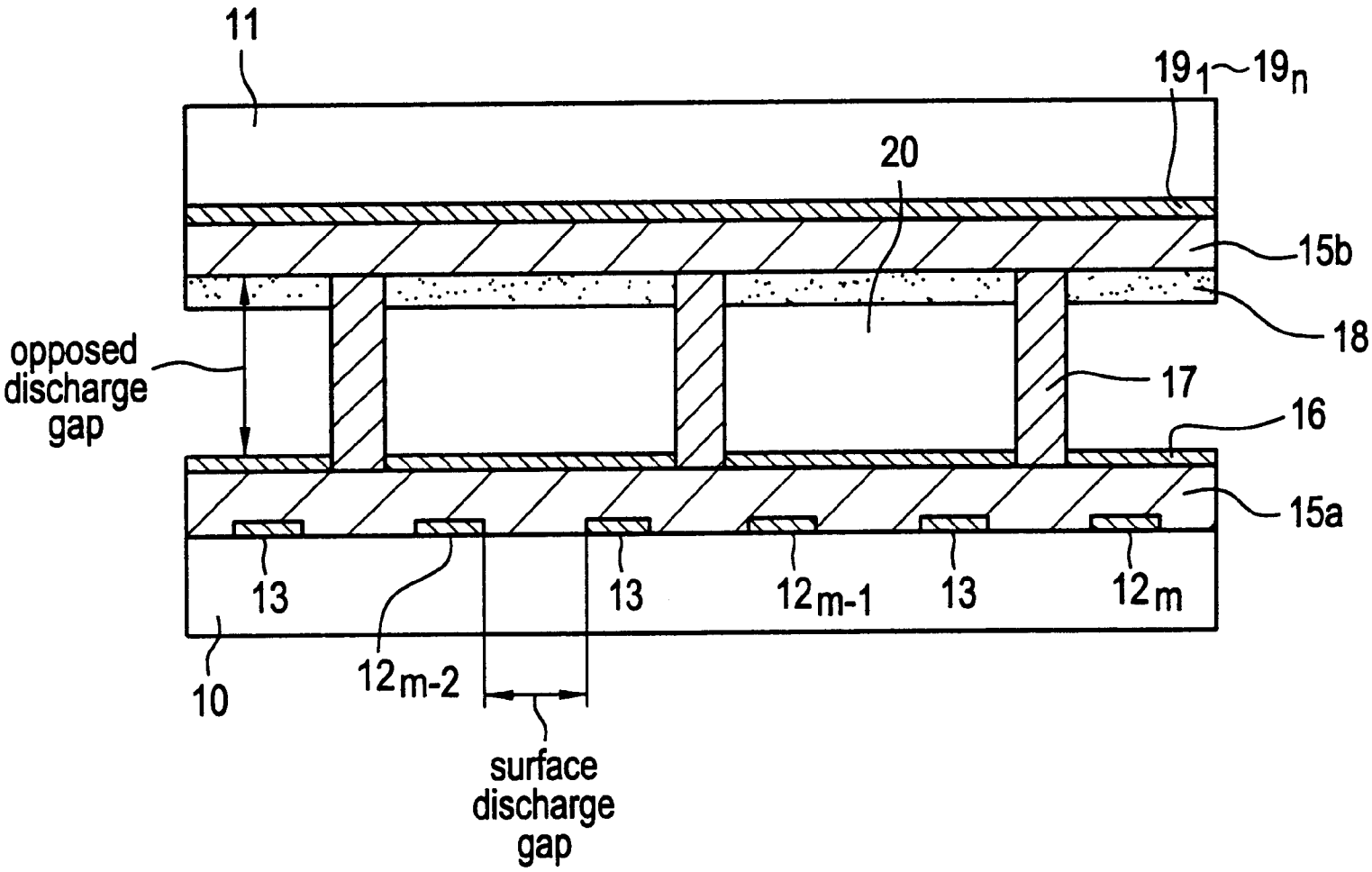
FIG. 1 PRIOR ART
FIG. 1 is a sectional view showing a structure of a conventional color PDP.
Figure 2:
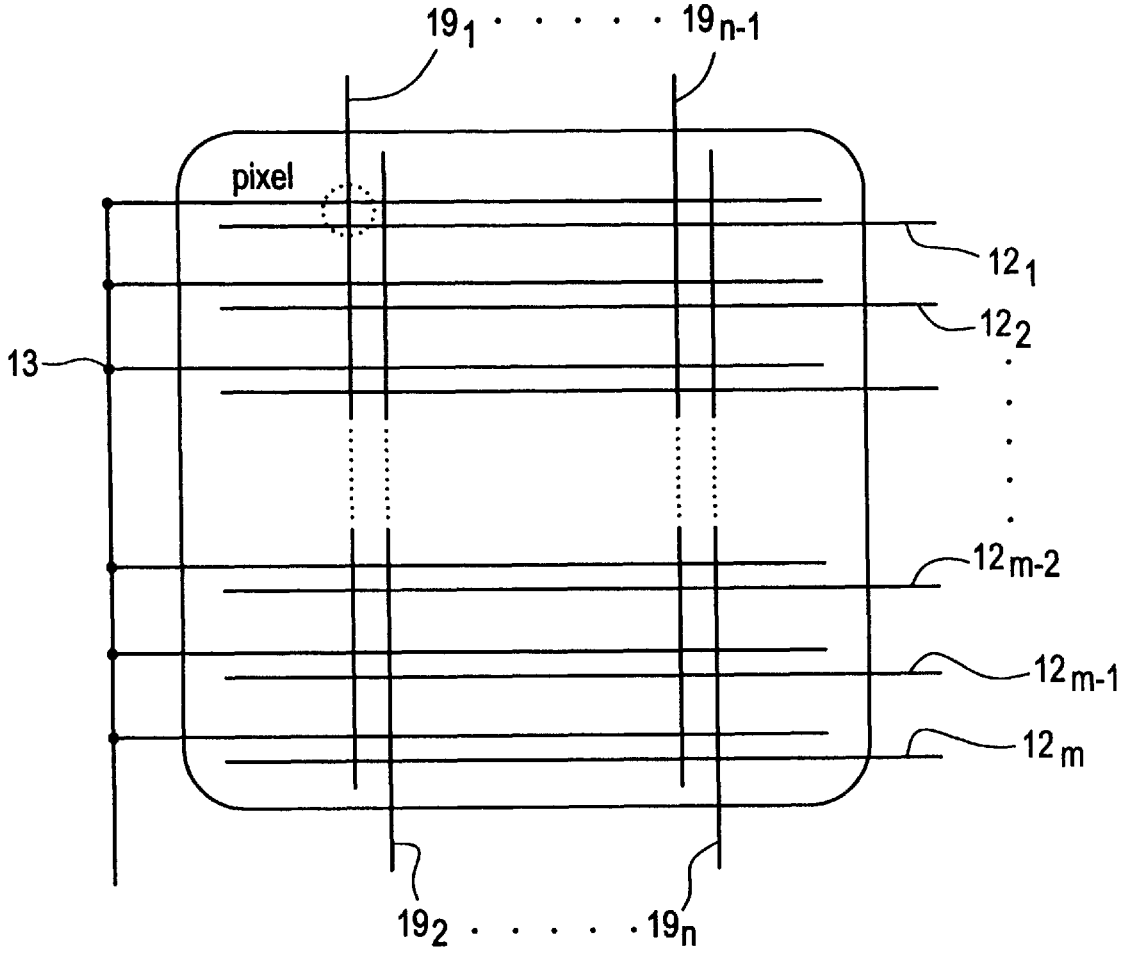
FIG. 2 PRIOR ART
FIG. 2 is a plane view showing an electrode structure of the color PDP of FIG. 1.
Figure 3:
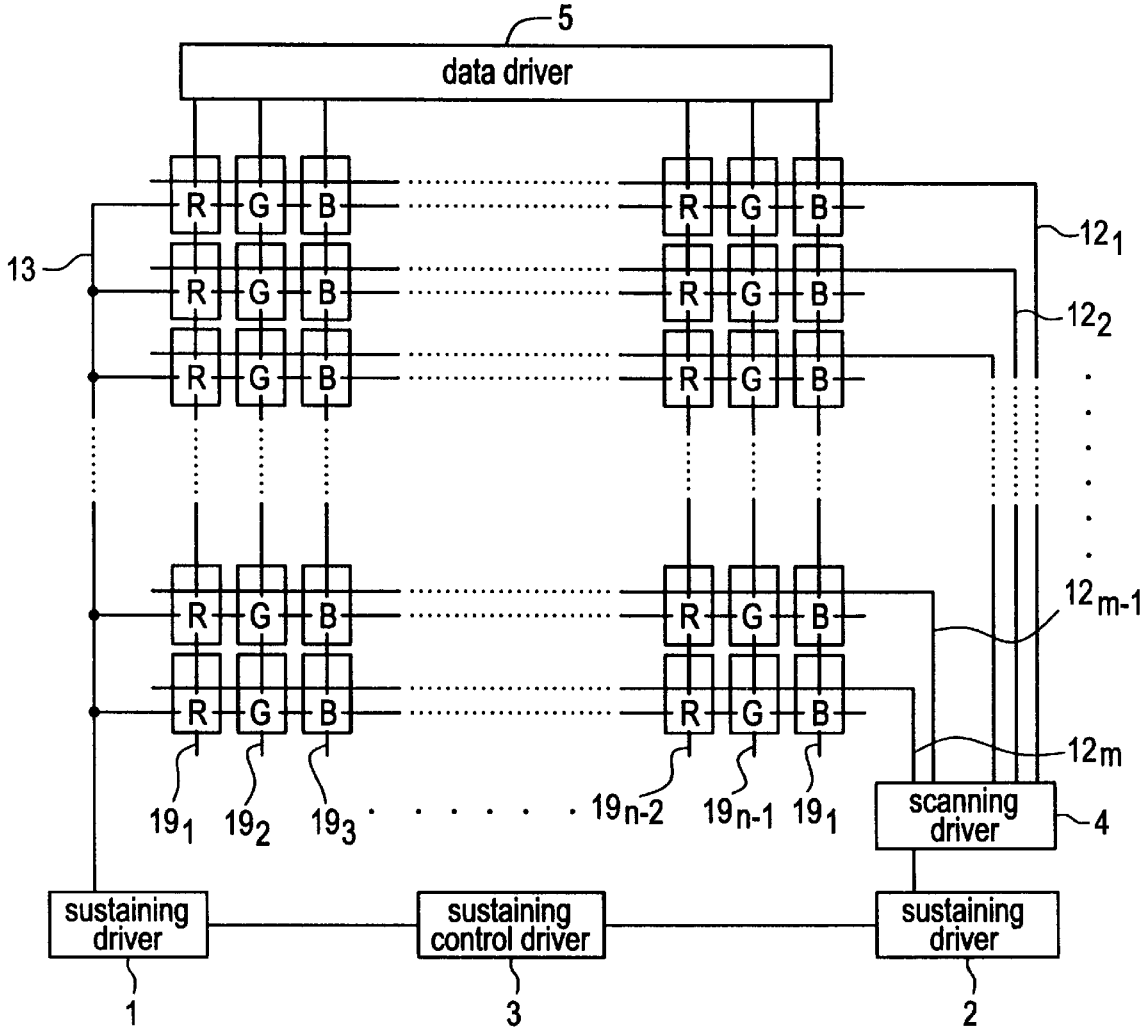
FIG. 3 PRIOR ART
FIG. 3 is a structure diagram showing drivers of the color PDP of FIG. 1 and a pixel arrangement in the color PDP.

The color PDP of the present embodiment is an improvement to and different from the conventional color PDP of FIG. 3 in that data driver 5 is divided for the individual emitted light colors into R data driver 5*a,* G data driver 5*b* and B data driver 5*c.* Further, data electrodes $\mathbf{19}_1$, $\mathbf{19}_4$, . . . , $\mathbf{19}_{n-2}$ which form pixel columns of R are connected to R data driver 5*a,* data electrodes $\mathbf{19}_2$, $\mathbf{19}_5$, . . . , $\mathbf{19}_{n-1}$ which form pixel columns of G are connected to G data driver 5*b,* and data electrodes $\mathbf{19}_3$, $\mathbf{19}_c$, . . . , $\mathbf{19}_n$ which form pixel columns of B are connected to B data driver 5*c,* for the individual emitted light colors.

The three kinds of data drivers 5*a,* 5*b* and 5*c* which correspond to the three emitted light colors of R, G and B can adjust the data pulse widths, output voltages and output timings thereof independently of each other and can be set so that write discharge of pixels of the individual emitted light colors may occur appropriately. Consequently, for example, when a same data pulse is used, if the voltage or time with which write discharge occurs with the pixels of G is higher or longer than the voltage or time with which write discharge occurs with the pixels of the other emitted light colors, such adjustment as to raise the output voltage value or increase the pulse width of the data pulses to be outputted from G data driver 5*b* can be performed to cause the conditions with which write discharge occurs with the G pixels to coincide with the conditions with which write discharge is started with the pixels other than the G pixels.

Further, while, in the conventional color PDP, an unnecessarily high data pulse voltage is applied to R and B pixels in order to effect writing into G pixels, resulting in consumption of unnecessarily high power, in the present embodiment, since the voltage to be applied to R and B pixels may be lower than that of the conventional color PDP, also the effect of reduction in power dissipation can be achieved.

Second Embodiment

Now, a second embodiment of the present invention is described with reference to FIG. 8.

Figure 8:
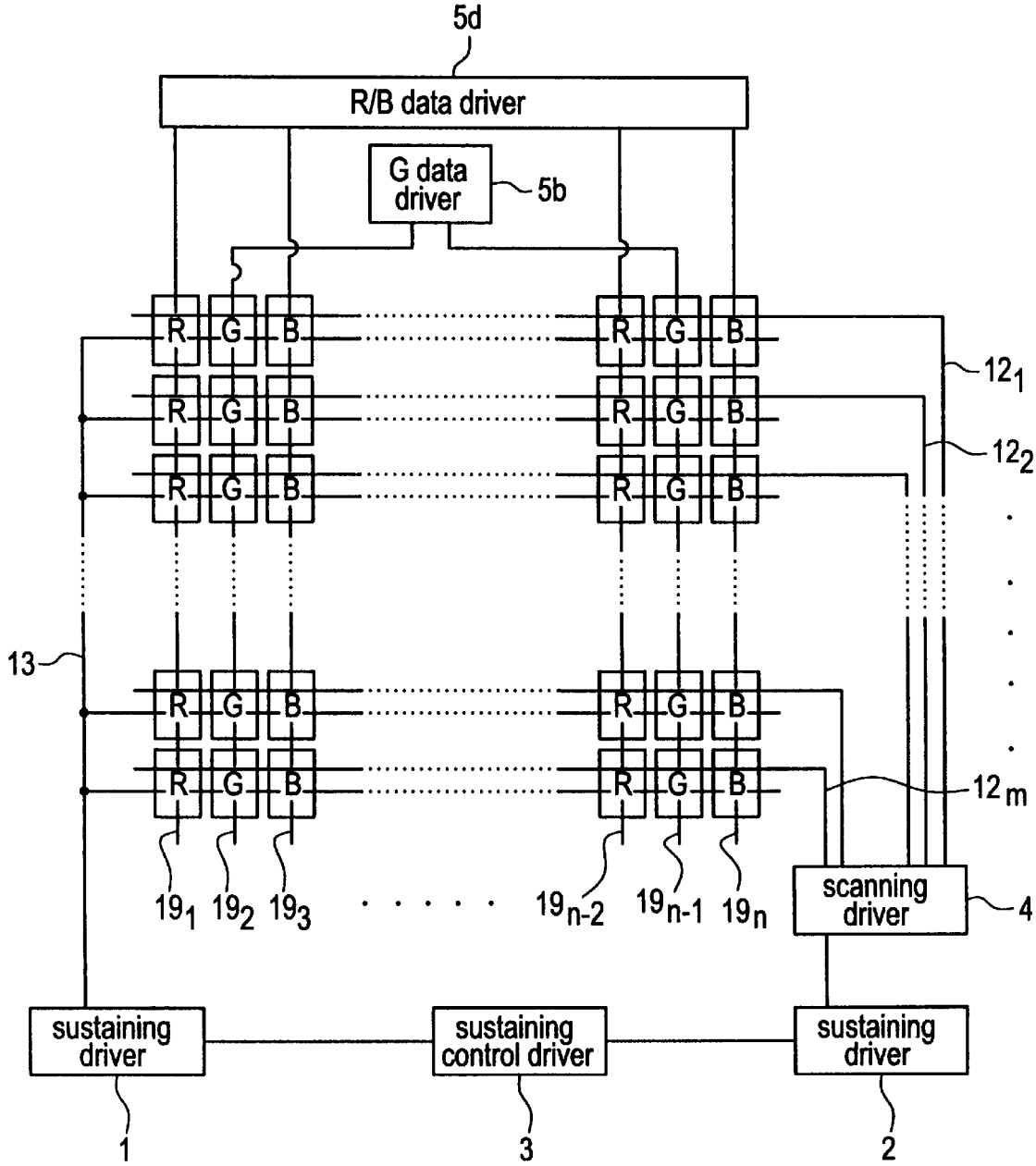
FIG. 8 is a structure diagram showing drivers of a color PDP of a second embodiment of the present invention and a pixel arrangement in the color PDP.

FIG. 8 is a structure diagram showing drivers of the color PDP of the second embodiment of the present invention and a pixel arrangement in the color PDP. In FIG. 8, same reference symbols as those in FIG. 3 denote same components.

The color PDP of the present embodiment is an improvement to and different from the conventional color PDP of FIG. 3 in that data driver 5 is divided into G data driver 5*b* which outputs data pulses to G pixels and R/B data driver 5*d* which outputs data pulses to R pixels and B pixels. Further, data electrodes $\mathbf{19}_2$, $\mathbf{19}_5$, . . . $\mathbf{19}_{n-1}$ which form pixel columns of G are connected to G data driver 5*b* while the other data electrodes are connected to R/B data driver 5*d*.

RIB data driver 5*d* and G data driver 5*b* can adjust the data pulse widths, output voltages and output timings thereof independently of each other and can be set so that write discharge of pixels of the individual emitted light colors may occur appropriately.

Figure 6A:
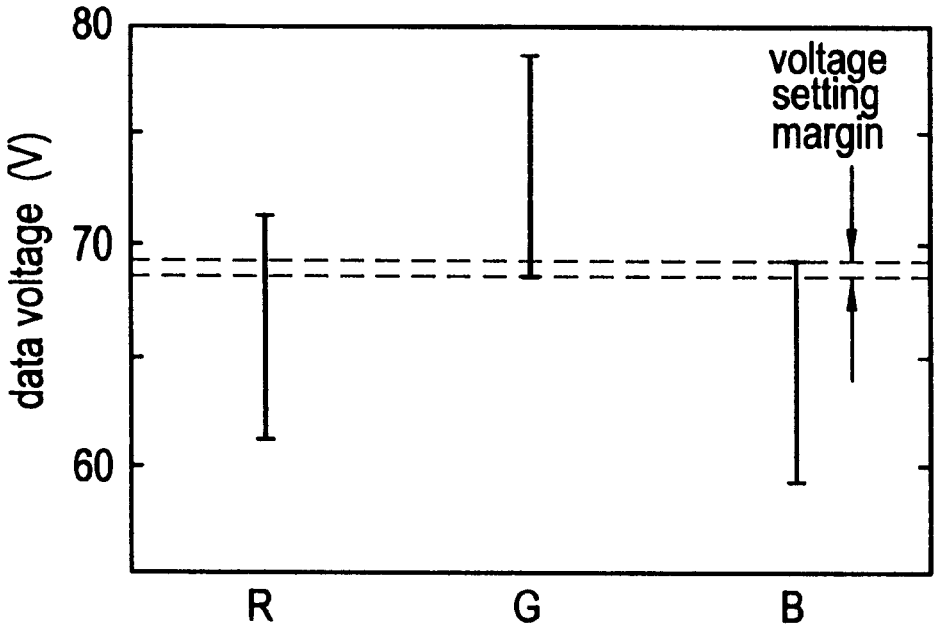
FIG. 6A PRIOR ART
FIG. 6*a* is a characteristic diagram illustrating an example of a data pulse voltage range necessary for write discharge when a same scanning pulse is applied.

Normally, as seen in FIG. 6*a*, only the G pixels exhibit a remarkably high voltage comparing with the pixels of R and G. Accordingly, even if the three colors of R, G and B are not controlled separately from each other in such a manner as in the first embodiment, similar effects to those of the first embodiment can be achieved by controlling only the G pixels independently of the pixels of the other two colors.

Third Embodiment

Figure 9:
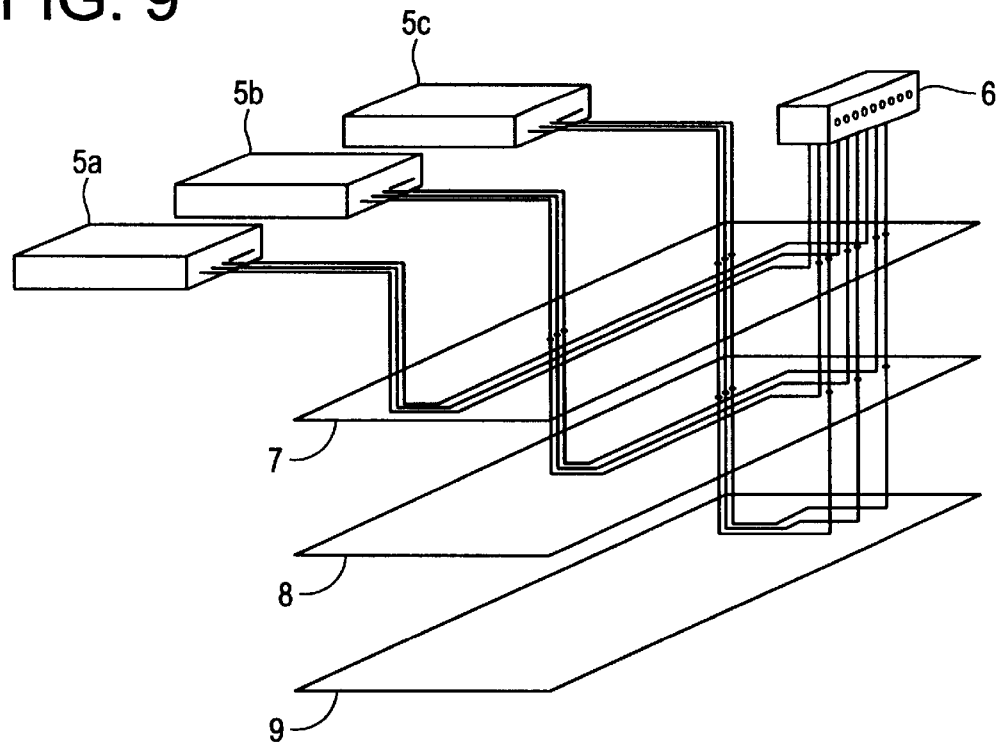
FIG. 9 is a structure diagram showing data drivers and output terminals of a color PDP of a third embodiment of the present invention.

Next, a third embodiment of the present invention is described with reference to FIG. 9.

The present embodiment is a modification to and is different from the first embodiment in that, in connection of output signal lines of R data driver 5*a*, G data driver 5*b* and B data driver 5*c* to three kinds of data electrodes which form pixel columns of same emitted light colors from among data electrodes $\mathbf{19}_1$ to $\mathbf{19}_n$, a three-layer substrate is used such that the output signal lines are re-arranged so as to correspond to data electrodes $\mathbf{19}_1$ to $\mathbf{19}_n$.

The three-layer substrate is composed of R wiring line layer 7, G wiring line layer 8 and B wiring line layer 9. The output signal lines of R data driver 5*a* are wired in R wiring line layer 7, the output signal lines of G data driver 5*b* are wired in G wiring line layer 8, and the output signal lines of B data driver 5*c* are wired in B wiring line layer 9, such that the output signal lines are re-arranged in order of RGB . . . RGB corresponding to the arrangement of data electrodes $\mathbf{19}_1$ to $\mathbf{19}_n$ at output terminal 6.

Further, in the second embodiment, if a substrate of two or more layers is used, then re-arrangement of output signal lines is possible.

Further, while the first and second embodiments of the present invention of FIGS. 7 and 8 employ a data electrode one side extraction panel wherein connections between data electrodes $\mathbf{19}_1$ to $\mathbf{19}_n$ and the data drivers are provided only on one side of the pixel matrix, the present embodiment can be applied to a both side extraction panel which is used ordinarily and wherein every other ones of data electrodes $\mathbf{19}_1$ to $\mathbf{19}_n$ are arranged at an upper portion and a lower portion of the pixel matrix.

Fourth Embodiment

Next, a fourth embodiment of the present invention is described with reference to FIG. 10.

Figure 10:
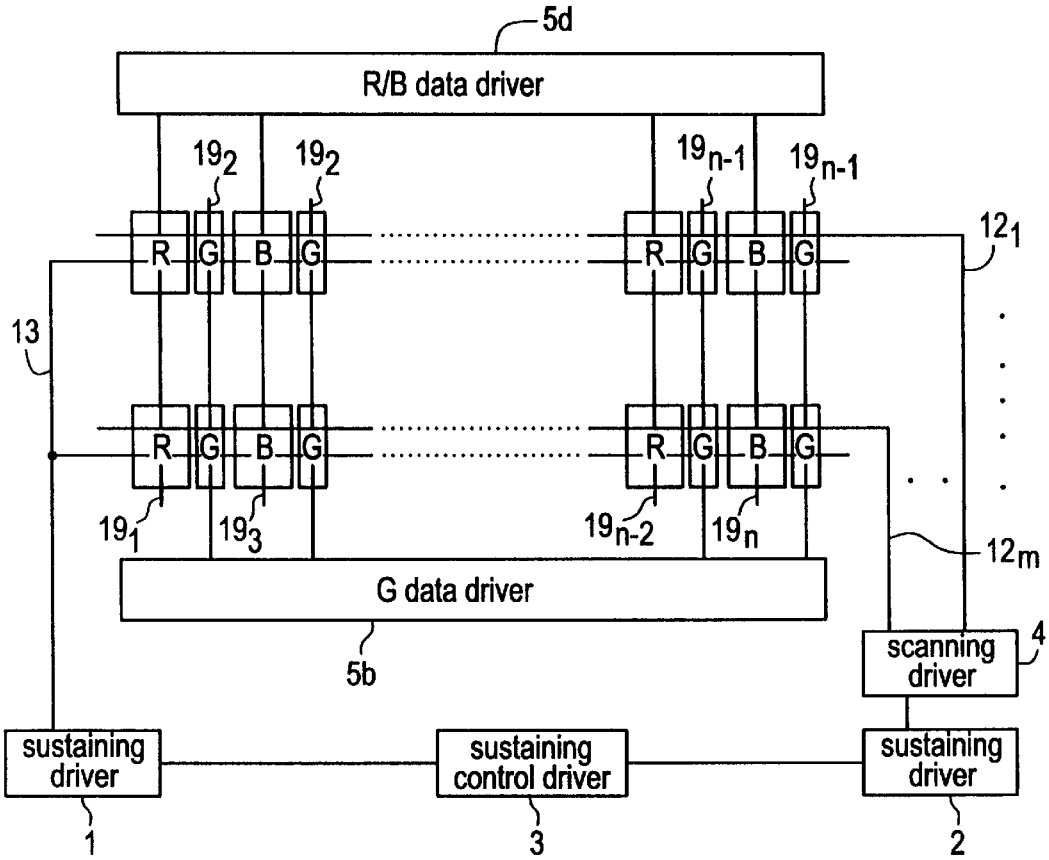
FIG. 10 is a structure diagram showing drivers of a color PDP of a fourth embodiment of the present invention and a pixel arrangement in the color PDP.

FIG. 10 is a structure diagram showing drivers of a color PDP of the third embodiment of the present invention and a pixel arrangement in the color PDP.

The color PDP of the present invention is a modification to and different from the second embodiment of FIG. 8 in that one picture element is composed of a total of four pixels including one R pixel, two G pixels and one B pixel and R/B data driver 5*d* is provided at an upper portion of a panel while G data driver 5*b* is provided at a lower portion of the panel, and data electrodes $\mathbf{19}_1$, $\mathbf{19}_4$, . . . , $\mathbf{19}_{n-2}$ which form pixel columns of R and data electrodes $\mathbf{19}_3$, $\mathbf{19}_6$, . . . , $\mathbf{19}_n$ which form pixel columns of B are connected to R/B data driver 5*d* while data electrodes $\mathbf{19}_2$, $\mathbf{19}_5$, . . . , $\mathbf{19}_{n-1}$ which form pixel columns of G are connected to G data driver 5*b*, thus in two systems.

In the color PDP of the present embodiment, since data electrodes $\mathbf{19}_1$ to $\mathbf{19}_n$ are alternately extracted upwardly and downwardly, data electrodes $\mathbf{19}_2$, $\mathbf{19}_5$, . . . , $\mathbf{19}_{n-1}$ which are extracted downwardly all correspond to the G pixel columns while the data electrodes other than them which are extracted upwardly correspond to the R and B pixel columns. Consequently, it is required only to provide R/B data driver 5*d* at an upper portion and provide G data driver 5*b* at a lower portion, and no conversion in arrangement is required. Accordingly, there is no need of re-arrangement from the arrangement of the output signal lines of the data drivers to the arrangement of data electrodes $\mathbf{19}_1$ to $\mathbf{19}_n$, and wiring is facilitated.

Fifth Embodiment

Now, a fifth embodiment of the present invention is described with reference to FIGS. 11*a* and 11*b*.

Figure 11A:
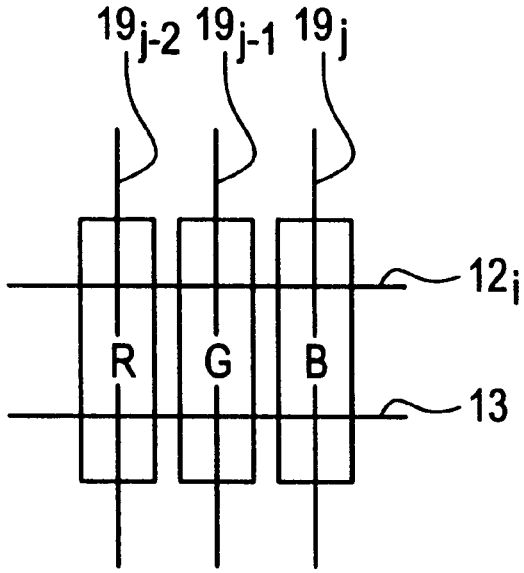
FIG. 11*a* is a structure diagram showing a pixel arrangement of a color PDP of a fifth embodiment of the present invention.
Figure 11B:
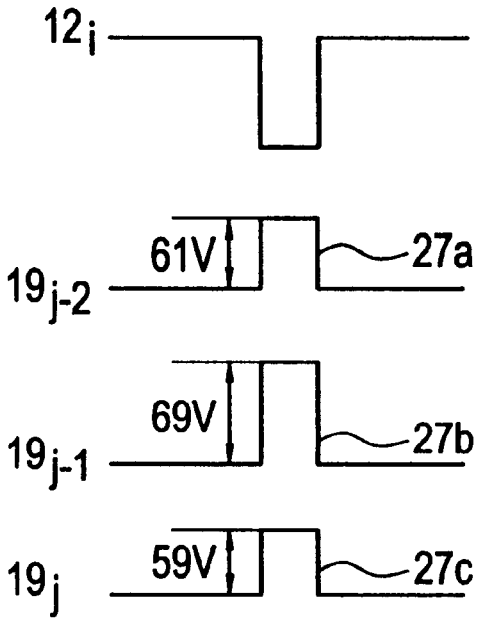
FIG. 11*b* is a driving waveform diagram including a scanning pulse and a data pulse.

FIG. 11*a* is a structure diagram showing a pixel arrangement of a color PDP of the fifth embodiment of the present invention, and FIG. 11*b* is a driving waveform diagram including a scanning pulse and a data pulse. In FIGS. 11*a* and 11*b*, same reference symbols as those in FIG. 3 denote same components.

The color PDP of the present embodiment is an improvement to and different from the color PDP of FIG. 3 in that an IC of a high voltage resisting property or a like element is used so that data driver 5 can output data pulses of three different voltage values such that data pulses 27*a*, 27*b* and 27*c* of different voltages can be outputted from one data driver individually to pixel columns of R, G and B.

The picture element shown in FIG. 11*a* is an arbitrary one picture element in an RGB pixel matrix which includes a B pixel in the ith row and the jth column, a G pixel in the ith row and the (j−1)th column and an R pixel in the ith row and the (j−2)th column. Here, the range of i is $1 \leqq i \leqq m$, and the values which can be taken by j are j=3, 6, 9, . . . , n−6, n−3, n.

For example, where the data voltages necessary for writing for the individual emitted light colors have such characteristics as illustrated in FIG. 6*a*, the voltage value of data pulse 27*a* is set to 61 V, the voltage value of data pulse 27*b* is set to 69 V, and the voltage value of data pulse 27*c* is set to 59 V as seen in FIG. 11*b*. Consequently, since the voltages of write discharge to the individual pixels are set so as to be optimum for the pixels of the individual emitted light colors, a difference in write characteristic arising from a difference in emitted light color is eliminated, and consequently, good write discharge occurs with all pixels and the display quality is improved.

Further, sufficient effects can be achieved only if the voltage of data pulse 27*b* to be outputted to the G pixel columns is set higher than the voltages of data pulses 27*a* and 27*c* to be outputted to the other R and B pixels.

The present embodiment can be realized comparatively simply since crossing of data electrodes $\mathbf{19}_1$ to $\mathbf{19}_n$ with each other which appears in the first to third embodiments is eliminated and there is no need of employing such modification of the structure of the panel as in the fourth embodiment.

Figure 4:
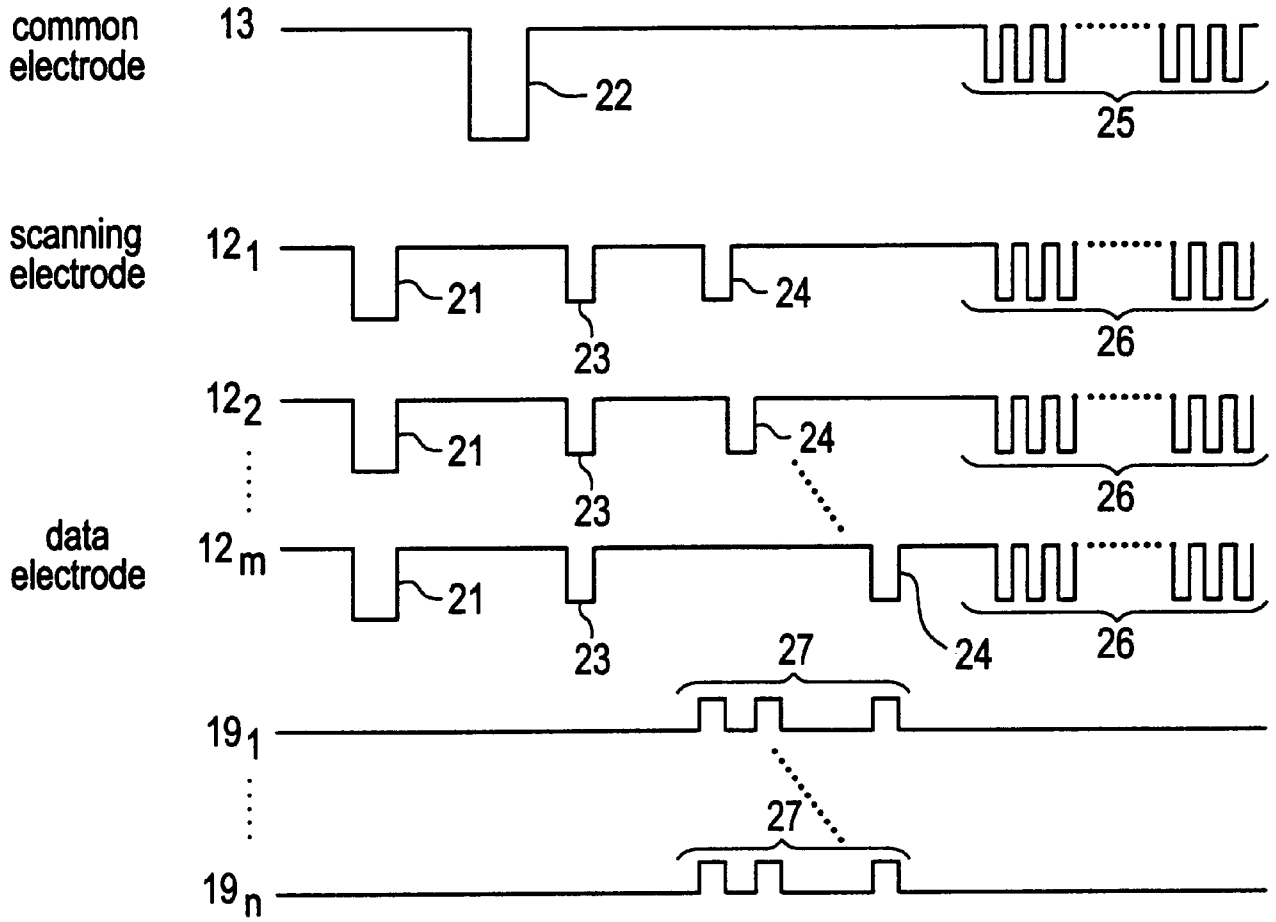
FIG. 4 PRIOR ART
FIG. 4 is a timing chart showing waveforms of driving voltages applied to the color PDP of FIG. 1.
Figure 5A:
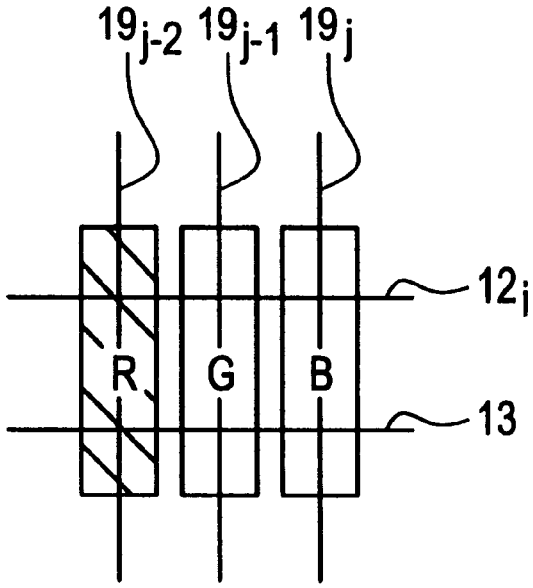
FIG. 5A PRIOR ART
FIG. 5*a* is a structure diagram showing a pixel arrangement of the color PDP of FIG. 1.
Figure 5B:
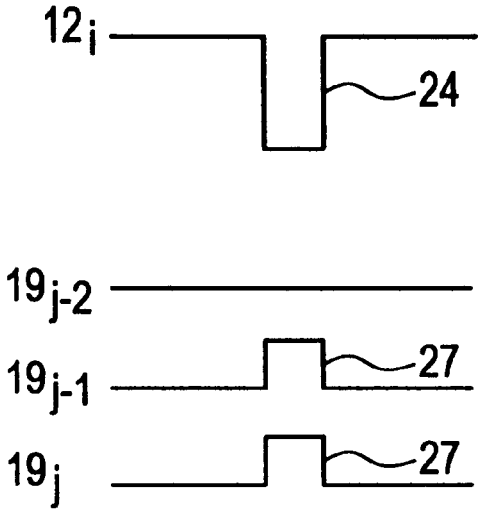
FIG. 5B PRIOR ART
FIG. 5*b* is a driving waveform diagram of the color PDP of FIG. 1.

While, in the first to fifth embodiments described above, a case wherein driving waveforms of the scanning-sustaining separation system of FIG. 4 wherein a scanning period in which write discharge occurs selectively for each pixel and a sustaining period in which sustaining discharge continues are separate from each other are used as driving waveforms for the color PDP, the present invention is not limited to this and can be applied also to another case wherein driving waveforms of the scanning-sustaining mixture system in which scanning pulses are interposed between sustaining pulses.

Further, while the driving waveforms used in the first to fifth embodiments described above exhibit that scanning pulses and sustaining pulses are negative pulses and data pulses are positive pulses, the present invention does not rely upon the polarities of the pulses and can be applied to all driving waveforms such as where the scanning pulses have the positive polarity and the data pulses have the negative polarity.

Further, also with regard to the structure of the color PDP, similar effects can be achieved by a structure different from the structure shown in FIG. 7 wherein sustaining discharge is performed by surface discharge such as, for example, a structure wherein sustaining discharge is performed by opposed discharge or another structure wherein electrodes are formed on partitions and sustaining discharge is performed by opposing ones of the electrodes.

Furthermore, while a case wherein, when data pulses are divided into two systems in the second, fourth and fifth embodiments of the present invention, the voltage necessary for writing of G pixels is extremely higher than those of pixels of the other two colors is described with reference to the characteristic diagram of FIG. 6*a* which illustrates a data pulse voltage range necessary for writing, depending upon the kind of a phosphor to be used, R or B pixels sometimes exhibit an extremely higher voltage than those of the other two colors. Conversely, pixels of a certain one color may possibly be written with a voltage extremely lower than those of the other two colors.

In those cases, pixels of one kind which exhibit a singular voltage value should be controlled with data pulses of a system different from those for pixels of the other two kinds as in the present invention wherein G pixels are controlled with data pulses of a different system from those of R and B pixels.

Figure 6B:
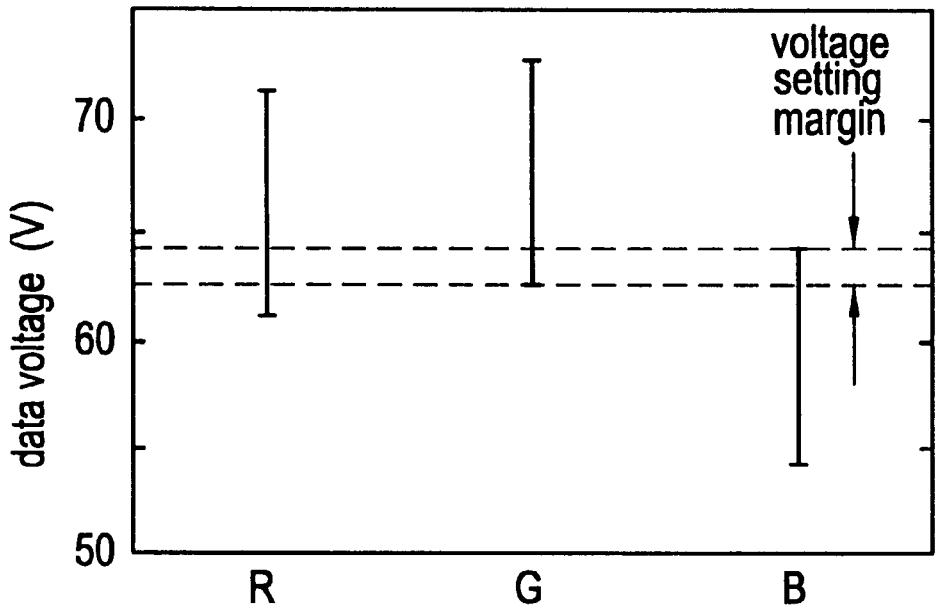
FIG. 6B PRIOR ART
FIG. 6*b* is a characteristic diagram illustrating another example of a data pulse voltage range necessary for write discharge.

For example, where the data pulse voltage range necessary for write discharge is such a characteristic as illustrated in FIG. 6*b*, the data pulse voltage necessary for writing of B pixels is extremely lower than those of pixels of the other two kinds. In such a case, similar effects can be achieved by employing the second, fourth or fifth embodiment of the present invention while a system of data pulses to be applied to the B pixels is made different from those of data pulses to be applied to the R and G pixels.

Further, while the first to fifth embodiments described above employ data drivers which can adjust the output pulse widths, output voltages and output timings thereof, only one of the output pulse widths, output voltages and output timings may be made adjustable independently of each other.

While preferred embodiments of the present invention have been described using specific terms, such description is for illustrative purposes only, and it is to be understood that changes and variations may be made without departing from the spirit or scope of the following claims.

What is claimed is:

1. A color plasma display panel, comprising:

a plurality of scanning electrodes provided on a row side of an RGB pixel matrix;

a plurality of data electrodes provided on a column side of said RGB pixel matrix;

a scanning driver for outputting scanning pulses at different timings from each other to said scanning electrodes; and a a plurality of data drivers for outputting data pulses corresponding to display information to be displayed by said data electrodes in a timed relationship with the timings at which the scanning pulses are outputted, said plurality including a first data driver for outputting data pulses only to R pixel columns of said RGB pixel matrix, a second data driver for outputting data pulses only to G pixel columns of said RGB pixel matrix, and a third data driver for outputting data pulses only to B pixel columns of said RGB pixel matrix.

2. A color plasma panel as claimed in claim 1, wherein output signal lines of said first, second and third data drivers are arranged on respective layers of a multi-layer substrate and are connected to said data electrodes.

3. A color plasma display panel as claimed in claim 1, wherein each of said data drivers can adjust at least one of an output pulse width, an output voltage and an output timing thereof independently of each other.

4. A color plasma display panel as claimed in claim 3, wherein output signal lines of said first, second and third data drivers are arranged on respective layers of a multi-layer substrate and are connected to said data electrodes.

5. A color plasma display panel, comprising:

a plurality of scanning electrodes provided on a row side of an RGB pixel matrix;

a plurality of data electrodes provided on a column side of said RGB pixel matrix;

a scanning driver for outputting scanning pulses at different timings from each other to said scanning electrodes; and a a plurality of data drivers for outputting data pulses corresponding to display information to be displayed by said data electrodes in a timed relationship with the timings at which the scanning pulses are outputted, said plurality including a first data driver for outputting data pulses to two kinds of pixel columns from among three kinds of pixel columns of R, G and B of said RGB pixel matrix, and a second data driver for outputting data pulses only to the remaining one kind of pixel columns.

6. A color plasma display panel as claimed in claim 5, wherein output signal lines of said first and second data drivers are arranged on respective layers of a multi-layer substrate and are connected to said data electrodes.

7. A color plasma display panel as claimed in claim 5, wherein each of said data drivers can adjust at least one of an output pulse width, an output voltage and an output timing thereof independently of each other.

8. A color plasma display panel as claimed in claim 7, wherein output signal lines of said first and second data drivers are connected to said data electrodes, and are arranged on respective layer of a multi-layer substrate.

9. A color plasma display panel, comprising:

a plurality of scanning electrodes provided on a row side of an RGB pixel matrix;

a plurality of data electrodes provided on a column side of said RGB pixel matrix;

a scanning driver for outputting scanning pulses at different timings from each other to said scanning electrodes; and a data driver for outputting data pulses having a plurality of different voltage values corresponding to display information to be displayed by said data electrodes in a timed relationship with the timings at which the scanning pulses are outputted.

10. A color plasma display as claimed in claim 9, wherein said voltage values are optimum voltage values associated with emitted light colors of R, G and B pixels of said RGB pixel matrix.

* * * * *

UNITED STATES PATENT AND TRADEMARK OFFICE

CERTIFICATE OF CORRECTION

PATENT NO. : 6,097,365
DATED : August 01, 2000
INVENTOR(S) : Mitsuyoshi MAKINO

It is certified that error appears in the above-identified patent and that said Letters Patent is hereby corrected as shown below:

Column 6, line 52, delete "$19_c$" insert --$19_6$--

Signed and Sealed this

Eighth Day of May, 2001

*Attest:*

Nicholas P. Godici

NICHOLAS P. GODICI

*Attesting Officer*

*Acting Director of the United States Patent and Trademark Office*